US005327507A

United States Patent [19]

Suzuki

[11] Patent Number: 5,327,507

[45] Date of Patent: Jul. 5, 1994

[54] HEADPHONE APPARATUS

[75] Inventor: Akihisa Suzuki, Hiroshima, Japan

[73] Assignee: Sharp Kabushiki Kaisha, Osaka, Japan

[21] Appl. No.: 680,253

[22] Filed: Apr. 4, 1991

[30] Foreign Application Priority Data

Apr. 10, 1990 [JP] Japan ..... 2-38889[U]

[51] Int. Cl.[5] ..... H04R 25/00

[52] U.S. Cl. ..... 381/183; 381/158; 381/159

[58] Field of Search ..... 381/183, 187, 159, 199, 381/192, 158; 181/129, 128, 135

[56] References Cited

U.S. PATENT DOCUMENTS 4,239,945 12/1980 Atoji et al. ..... 381/159
4,637,489 1/1987 Iwanaka et al. ..... 381/158
4,742,889 5/1988 Yamagishi ..... 181/129

FOREIGN PATENT DOCUMENTS 61-195188 12/1986 Japan .
64-8519 2/1989 Japan .

*Primary Examiner*—Curtis Kuntz
*Assistant Examiner*—Huyen D. Le

[57] ABSTRACT

An inner-ear type headphone apparatus includes a diaphragm, a driving portion, a backside wall, and a sealed wall plane. A diaphragm backside space is formed between the diaphragm and the driving portion. The driving portion drives the diaphragm. A back cavity communicates with a diaphragm backside space. The back cavity is formed between the driving portion and the backside wall. There is a sound-absorbing space between the backside wall and the sealed wall plane. The backside wall is provided with through-holes communicating the back cavity with the sound-absorbing space. The sound absorbing space is separated from external space by the sealed wall plane. Sound output of low frequency range is enhanced for the user of the headphone apparatus, with satisfactory frequency characteristics maintained where there is no drop in sound output of middle frequency range. Also, the amount of leakage of unpleasant sound wave of high frequency range to external space is reduced.

1 Claim, 2 Drawing Sheets

HEADPHONE APPARATUS

BACKGROUND OF THE INVENTION

1. Field of the Invention

The present invention relates to headphone apparatus, and more particularly, to a headphone apparatus having improved frequency characteristics in low frequency range. This invention is applicable, for example, to an inner-type headphone apparatus.

2. Description of the Background Art

The structure of a conventional inner-ear type headphone apparatus will be explained hereinafter. FIG. 1 is a sectional view of a structure of a conventional headphone apparatus.

Referring to FIG. 1, a dome-like diaphragm (vibration plate) 31 and a driving portion 32 are formed at the opening end side of a cylinder portion 34 of a case 33. Driving portion 32 drives diaphragm 31. Cylinder portion 34 has a bottom at the lower portion thereof. Driving portion 32 is constituted by a magnetic circuit portion comprising a magnet 36. The magnetic field of magnet 36 acts on a voice coil 35. Voice coil 35 is joined to diaphragm 31. A flow of audio signal current to voice coil 35 causes the vibration of diaphragm 31. This vibration generates compression waves in the space at the forward side of diaphragm 31 (the upper side in the figure) to produce sounds.

There is a back cavity 38 at the rear side of driving portion 32. This back cavity 38 communicates with diaphragm backside space 37 between diaphragm 31 and driving portion 32. Back cavity 38 suppresses the influence of compression waves generated also in the air at the rear side of diaphragm 31 to enhance the low frequency range.

A backside wall 39 of case 33 covering back cavity 38 from the backside is formed with a plurality of slit-like through-holes 40 for adjusting frequency characteristics. These through-holes 40 are provided to suppress reduction in sound output of middle frequency range specific to the configuration of back cavity 38. In other words, these through-holes 40 have opening configuration in accordance with the middle frequency range thereof. If through-holes 40 are not provided, a particular frequency range reflected from backside wall 39, i.e. the sound wave of middle frequency range which is of opposite phase interferes with the sound wave emitted forwards from diaphragm whereby the output of middle frequency range is reduced, for example. If through-holes 40 are provided as slits in accordance with the middle frequency range, at least one portion of the sound wave of the particular middle frequency range escapes backwards through-holes 40. This will reduce the interference between sound wave from diaphragm 31 to the forward direction and the sound wave of the particular middle frequency range. This results in improvement of frequency characteristics that are output from diaphragm 31.

In the above mentioned conventional headphone apparatus, the sound wave of middle frequency range is attenuated to some extent upon passing through-holes 40 having narrow gaps. Therefore, the intensity of sound of middle frequency range leaking to external space (outside the headphone apparatus) is lowered. However, sound wave of high frequency range is hardly attenuated even when passing through-hole 40 provided in accordance with the middle frequency range. Sound wave of high frequency range leak to external space through these through-holes 40. The sounds of high frequency range are enhanced and that will annoy people close to the person wearing the headphone. Thus, there was a problem that the sound of high frequency range leaking from a headphone annoys people close to a person wearing a conventional headphone.

Japanese Patent Publication No. 64-8519 discloses a conventional inner-ear headphone apparatus. In Japanese Utility Model Laying-Open No. 61-195188, a structure of a headphone is disclosed capable of changing the capacity of a cavity corresponding to back cavity 38 shown in the aforementioned FIG. 1. The above publications do not have any recitation of a headphone structure for reducing the leakage of high frequency range sound.

SUMMARY OF THE INVENTION

An object of the present invention is to provide a structure of a headphone apparatus capable of reducing leakage of high frequency range sound wave through a through-hole to external space without reducing the improvement effect of frequency characteristics by the through-hole.

A headphone apparatus according to the present invention includes a diaphragm, a driving portion, a first wall, and a second wall. A first space is formed between the diaphragm and the driving portion. The driving portion drives the diaphragm. The first wall is provided to form a second space between the driving portion and the first wall. The second space communicates with the first space. A second wall is provide to form a third space between the first wall and the second wall. The first wall is formed with a through-hole that communicates the second space with the third space. The third space is separated from external space by the second wall.

In accordance with a preferred embodiment of the present invention, a plurality of through-holes are formed at predetermined intervals. The capacity of the third space is greater than that of the second space.

In the present invention, the through-hole provided in the first wall leads to the third space. The third space is separated from external space by the second wall. This reduces leakage of high frequency range sound wave passing the through-hole to external space. Sound wave of middle frequency range passing the through-hole can be attenuated in the interior of the third space between the first wall and the second wall. As a result, it is possible to minimize the intensity of sound waves passing the through-hole from the third space towards the diaphragm. Deterioration of improvement effect of frequency characteristics by the through-hole can be suppressed to prevent leakage of high frequency range sound wave to external space. According to the present invention, leakage of unpleasant high frequency range sound wave to the exterior can be suppressed without deteriorating the output frequency characteristic of an headphone apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be explained hereinafter with reference to the drawings.

Figure 1:
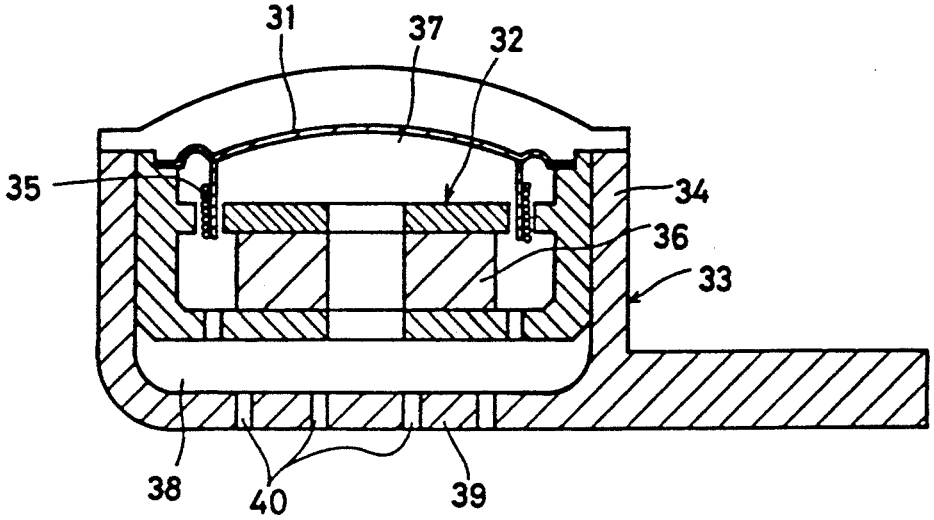
FIG.1 PRIOR ART
FIG. 1 is a sectional view of a structure of a conventional headphone apparatus.
Figure 2:
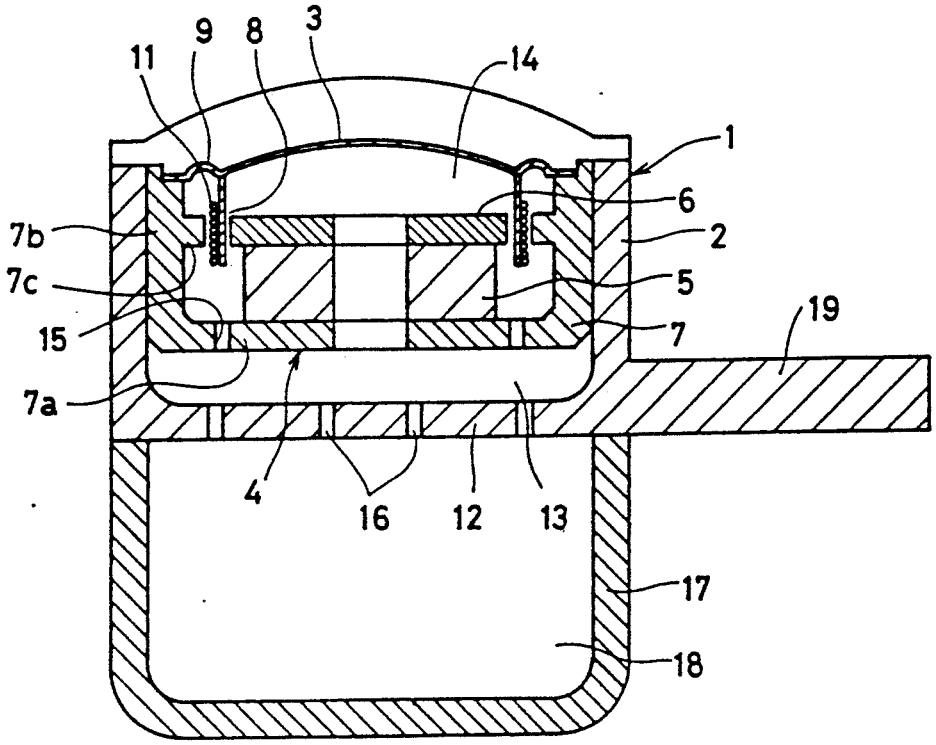
FIG. 2 is a sectional view of a structure of a headphone apparatus according to an embodiment of the present invention.

A structure of an inner-ear type headphone apparatus according to the present invention is shown in FIG. 2. Referring to FIG. 2, a case 1 comprises a cylinder portion 2. Cylinder portion 2 is formed to have an opening in the upper end thereof. A dome-like diaphragm 3 is provided to cover the opening in the upper side of cylinder portion 2. A driving portion 4 is formed in close proximity to and inward of the backside of diaphragm 3 (the lower portion in the figure).

Driving portion 4 implements a magnetic circuit portion constituted by a magnet 5, a top plate 6, and a yoke 7. Magnet 5 comprises a circular top configuration and is coaxial with cylinder portion 2. The ring-like top plate 6 is fixed to the upper surface of magnet 5. The section of yoke 7 is roughly U-shaped. Yoke 7 has a cylindrical configuration with a bottom.

A through-hole is provided in the bottom portion 7*a* of yoke 7. A through-hole having a configuration identical to that of the above mentioned hole is also provided respectively in magnet 5 and top plate 6 coaxially. The lower end surface of magnet 5 is fixed on bottom 7*a*. Magnet 5 and top plate 6 are provided substantially coaxially inside the cylinder portion 7*b* of yoke 7. The outer peripheral surface of the cylinder portion 7*b* of yoke 7 is fitted and fixed to the upper portion of the inner peripheral surface of the cylindrical portion 2 of case 1. Accordingly, driving portion 4 is attached inside case 1.

The outside diameter of top plate 6 is slightly greater than that of magnet 5. A protrusion 7*c* protruding towards the axis is formed in the inner peripheral surface of the cylinder portion 7*b* of yoke 7. Protrusion 7*c* is provided facing top plate 6 in the diameter direction. A gap 8 is formed having a predetermined distance between protrusion 7*c* and top plate 6.

An edge portion 9 is formed at the peripheral edge of diaphragm 3. Diaphragm 3 is connected to the upper surface of the cylinder portion 7*b* of yoke 7 by means of edge portion 9. The upper end of a voice coil 11 is connected inwards of edge portion 9 of diaphragm 3. Voice coil 11 extends downward having a hollow cylindrical configuration. The lower portion of voice coil 11 is located in gap 8.

The lower portion of cylinder portion 2 of case 1 is formed by backside wall 12. Backside wall 12 is located apart from bottom 7*a* of yoke 7. A space portion, i.e. a back cavity 13 having a predetermined capacity for low frequency range enhancement is provided between backside wall 12 and bottom 7*a*. Back cavity 13 communicates with diaphragm backside space 14 between diaphragm 3 and driving portion 4 through the center through-holes of top plate 6, magnet 5 and bottom portion 7*a* of yoke 7. Bottom 7*a* of yoke 7 is provided with a communicating hole 15 at a position outwards of magnet 5. Diaphragm backside space 14 also communicates with back cavity 13 through gap 8, the space between magnet 5 and cylinder portion 7*b* of yoke 7, and via communicating hole 15.

Backside wall 12 is provided with a plurality of slit-like through-holes 16 having a predetermined width and a predetermined pitch. Through-hole 16 serves to adjust the frequency characteristics. A sealed wall plane 17 is provided to cover the backside of backside wall 12. Sealed wall plane 17 is formed to cover backside wall 12 with distance from each through-hole 16. This will result in a sound-absorbing space 18 having a predetermined capacity between backside wall 12 and sealed wall plane 17.

A sideward projection 19 is provided in the outer peripheral surface of the cylinder portion 2 of case 1. Sideward projection 19 extends sidewards substantially from backside wall 12. A lead line (not shown) for transmitting sound current to voice coil 11 is implemented to be guided out through the internal of sideward projection 19.

With a headphone apparatus having the above described structure, a constant magnetic flux is generated in gap 8. When audio signal current flows to voice coil 11, a driving force according to Fleming's left hand rule acts on voice coil 11. Voice coil 11 vibrates in response to this audio signal current. This vibration is transmitted to diaphragm 3. Vibration of diaphragm 3 generates compression waves in the air at the forward side of diaphragm 3 (the upper side in FIG. 2) to produce sounds.

The above described vibration of diaphragm 3 also generates compression waves in the air at the back side of diaphragm 3, i.e. inside diaphragm backside space 14. Back cavity 13 is provided at the backside of driving portion 4 to suppress attenuation of sound emitted forwardly, particularly the sound of low frequency range, due to interference with compression waves. The communication between back cavity 13 and diaphragm backside space 14 allows sound output that is enhanced in low frequency range.

The slit-like through-holes 16 provided in backside wall 12 serves to adjust frequency characteristics. If through-holes 16 are not provided, sound of low frequency range is enhanced by back cavity 13, but the sound of a frequency range where the sound wave reflected from backside wall 12 is of opposite phase to sound wave emitted forwardly from diaphragm 3 is generated in a particular middle frequency range specific to the configuration of back cavity 13, for example. In this frequency range, sound output is reduced in proportion to the intensity of reflection wave. The degree of interference with sound wave forwardly from diaphragm 3 can be reduced by lowering the intensity of the reflection wave at backside wall 12. It is therefore possible to suppress the reduction in middle frequency range output.

Specifically, through-holes 16 having a slit-like configuration according to the above mentioned particular middle frequency range are provided in backside wall 12. At least one portion of sound wave of the particular middle frequency range escapes backwards through through-holes 16. This suppresses reduction of middle frequency range output to improve the frequency characteristics of sound output.

By providing slit-like through-holes 16 in backside wall 12 covering back cavity 13 for low frequency range enhancement, the frequency characteristics of sound output is improved. In a conventional headphone apparatus, the sound wave of middle frequency range is attenuated to some extent upon passing through-holes 16 of narrow gaps. Therefore, the intensity of sound of middle frequency range leaking outside is small enough. However, sound waves of high frequency range are hardly attenuated and leak outside through through-holes 16.

In the embodiment of the present invention, sealed wall plane 17 externally covering through-holes 16 are provided to prevent sound of high frequency range from leaking outside without deteriorating the improvement effect of frequency characteristics by through-holes 16. Sealed wall plane 17 is provided with a distance from through-holes 16. A sound-absorbing space 18 is formed between backside wall 12 and sealed wall plane 17. By sealing the exterior of through-holes 16 with sealed wall plane 17, sound wave of high frequency range passing through-holes 16 are blocked. Additionally, sound wave of middle frequency range passing through-holes 16 are attenuated within sound-absorbing space 18. Therefore, sound wave of middle frequency range from sound-absorbing space 18 through through-holes 16 towards diaphragm 3 is not generated. Accordingly, improvement effect of frequency characteristics by through hole 16 is not deteriorated.

The attenuation degree of sound wave of middle frequency range within sound-absorbing space 18, i.e., influence to frequency characteristics, depends on, for example the capacity, of sound-absorbing space 18. If the capacity of back cavity 13 is set to approximately 0.25 $cm^3$, the capacity of sound-absorbing space 18 is set to approximately 2.5 $cm^3$ that is ten times the capacity of back cavity 13. By specifying the capacity of back cavity 13 and sound-absorbing space 18, leakage of sound wave of high frequency range can be prevented without almost no reduction in frequency characteristics of sound output.

Figure 3:
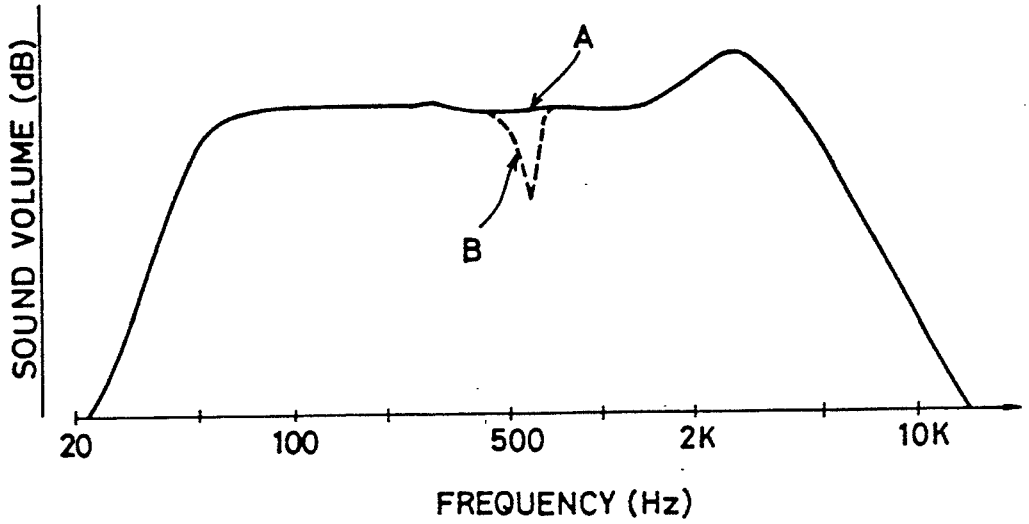
FIG. 3 is a graph showing an example of frequency analysis results of sound coming out from the headphone apparatus of FIG. 2.

FIG. 3 shows an example of frequency analysis result of output sound measured using the headphone apparatus of the above embodiment. The frequency analysis result measured at the front side of the headphone apparatus of the above embodiment, i.e. the frequency analysis result of sound towards the user of the headphone apparatus is shown in FIG. 3. It can be seen that there is a drop in sound output of middle frequency range centered around 600 Hz as shown by broken line B when slit-like through-holes 16 are not formed in backside wall 12. With the headphone apparatus of the above described embodiment, the drop in output of the middle frequency range is eliminated as shown in solid line A to realize satisfactory frequency characteristics.

Figure 4:
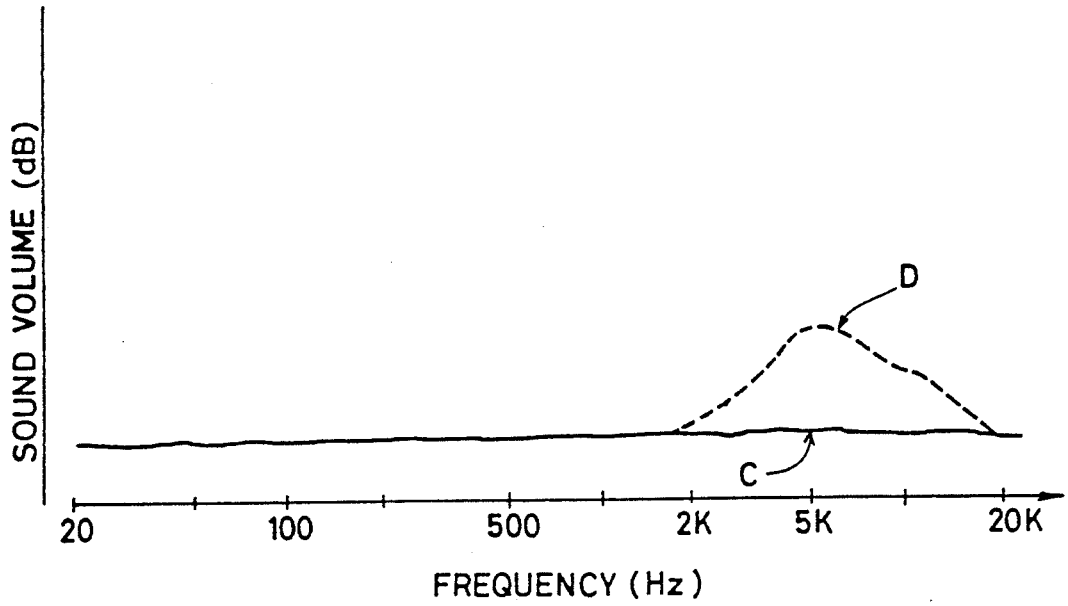
FIG. 4 is a graph of an example of frequency analysis result of sound leaking from the headphone apparatus of FIG. 2 to the exterior.

FIG. 4 shows frequency analysis result of sound output leaking from the headphone apparatus of the above embodiment. It can be seen from FIG. 4 that high frequency range around 5000 Hz leaks outside with a conventional headphone apparatus where through-holes 16 are not covered by sealed wall plane 17, as indicated by broken line D. With the headphone apparatus of the above embodiment, sound leaking outside is sufficiently reduced even in the above mentioned high frequency range to a volume level equivalent to that of other frequency range.

In accordance with the above embodiment, output of low frequency range is enhanced for the user of the headphone apparatus, where satisfactory sound output frequency characteristics are maintained without a drop in middle frequency range output. Furthermore, there is almost no leakage of high frequency range from the headphone apparatus to external space. There is no need to worry about annoying other people near by due to leakage of unpleasant high frequency range. This improves comfortability in the usage of a headphone apparatus.

Although the above-mentioned embodiment was described in which an inner-ear type headphone apparatus is employed, the present invention can be applied to other electroacoustic transducers such as an overhead type headphone apparatus.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A headphone apparatus comprising:

a diaphragm, a driving portion forming a first space between said driving portion and said diaphragm, a first wall provided to form a second space between said driving portion and said first wall, said second space communicating with said first space via holes, a second wall provided to form a third space between said first wall and said second wall, wherein said first wall includes through-holes communicating said second space with third space, and said third space is separated from external space by said second wall which seals and encloses said through-holes from said external space, so that waves of high frequency emitted via said through-holes do not pass to the external space, the capacity of said third space is greater than said second space and the capacity of said third space is ten times that of said second space.

* * * * *